US007797758B2

(12) United States Patent
Keppler et al.

(10) Patent No.: US 7,797,758 B2
(45) Date of Patent: Sep. 21, 2010

(54) FINGER PROTECTOR AND SPORTS GLOVE EQUIPPED THEREWITH

(75) Inventors: Thomas Keppler, Reutlingen (DE); Thomas Spitzer, Tieringen (DE)

(73) Assignee: Uhlsport GmbH, Balingen (DE)

( * ) Notice: Subject to any disclaimer, the term of this patent is extended or adjusted under 35 U.S.C. 154(b) by 1130 days.

(21) Appl. No.: 11/207,406

(22) Filed: Aug. 19, 2005

(65) Prior Publication Data

US 2006/0048259 A1 Mar. 9, 2006

(30) Foreign Application Priority Data

Sep. 6, 2004 (DE) ..... 20 2004 013 835

(51) Int. Cl.
*A41D 13/08* (2006.01)

(52) U.S. Cl. ..... 2/21; 2/160; 2/163; 2/161.1; 2/16; 2/20; 128/878; 128/879; 482/44; 482/47; 482/48

(58) Field of Classification Search ..... 2/21, 2/160, 163, 161.1, 16, 20, 161.6; 128/878, 128/879; 473/205; 482/44, 47, 48
See application file for complete search history.

(56) References Cited

U.S. PATENT DOCUMENTS

| | | | | |
|---|---|---|---|---|
| 883,761 | A * | 4/1908 | Taylor | 294/25 |
| 1,951,190 | A * | 3/1934 | Gambee | 2/21 |
| 3,593,803 | A * | 7/1971 | Ibach | 172/10 |
| 4,766,612 | A * | 8/1988 | Patton, Sr. | 2/16 |
| 6,557,177 | B2 | 5/2003 | Hochmuth | |
| 6,725,466 | B2 | 4/2004 | Hochmuth | |
| 6,925,653 | B1 * | 8/2005 | King | 2/21 |
| 2005/0251078 | A1 | 11/2005 | Fleischmann | |

FOREIGN PATENT DOCUMENTS

| | | | |
|---|---|---|---|
| DE | 27 21 410 | C2 | 10/1985 |
| DE | 35 16 545 | C2 | 11/1986 |
| DE | 200 11 652 | U1 | 10/2000 |
| DE | 100 10 403 | A1 | 9/2001 |
| DE | 100 10 404 | A1 | 9/2001 |
| DE | 102 44 236 | A1 | 3/2004 |
| EP | 1 203 602 | A2 | 5/2002 |
| EP | 1 273 323 | A2 | 1/2003 |
| JP | 11192335 | A | 7/1999 |
| WO | WO 2004/028282 | | 4/2004 |

* cited by examiner

*Primary Examiner*—Gary L Welch
*Assistant Examiner*—Alissa J Tompkins
(74) *Attorney, Agent, or Firm*—Frost Brown Todd LLC

(57) ABSTRACT

There is proposed a finger protector for a sports glove, including a plate that is connected in one piece with strips to be associated to several fingers of one hand, each strip consisting of a chain of members which are connected in one piece with each other and can be moved relative to each other in two opposite directions by means of through holes extending transverse to the chain direction, and a member band with nipples which are pushed into the through holes. The invention further relates to a sports glove incorporating such finger protector.

22 Claims, 2 Drawing Sheets

FINGER PROTECTOR AND SPORTS GLOVE EQUIPPED THEREWITH

The invention relates to a finger protector for a sports glove, in particular a goalkeeper glove, comprising a plate which is connected in one piece with strips to be associated to several fingers of one hand. The invention further relates to a sports glove equipped with such a finger protector.

A sports glove which especially can be used as a goalkeeper glove basically has to perform two functions: Firstly, it is supposed to protect the hand of a player against injuries at the best possible rate, in fact from the finger tips as far as to the wrist, and secondly the glove must not hinder its wearer during exertion of the sport, but instead support him. It is in particular the mobility of the glove-protected hand of the player that has to be preserved as far as possible, while the mechanical properties of the hand's skeleton are to be supported and strengthened by the glove. As there are quite considerable forces which may act on the sensitive skeleton parts and ligaments of the hand of a goalkeeper during catching and blocking a ball, these forces have to be absorbed very well and transmitted to the forearm in order to avoid injuries, in particular the spraining of the frontal phalanges to the rear.

For solving these problems there has already been proposed (DE-C-35 16 545) to produce the blank, associated to the back portion of the hand, of a sports glove from a composite material consisting of an inner, flexible and tear-proof material sheet and an outer material sheet composed of individual, lined-up elements. As the individual elements collide laterally when the material sheet is spread out flat, the material sheet can be curved in one direction in space only.

From DE-U-200 11 652 there is known a sports glove with a blank, associated to the back portion of the hand, in which a one-piece plate made of a shock-resistant plastic is embedded, which plate extends from the finger tips as far as to the wrist and can be elastically bent not only in one direction in space, but equally in diametrically opposite directions in space.

From DE-A-100 10 403 and DE 100 10 404 there are known goalkeeper gloves containing finger protectors in the form of segmented supporting elements, which are articulated to each other or coupled with each other through tensile means. As these finger protectors have to be manufactured of many individual parts movably connected with each other, production costs are accordingly high.

Finally, there have already been proposed stiffening strips for goalkeeper gloves (EP-A-1 203 602 and EP 1 273 323), such strips consisting of member bands which are connected with each other by hinges and have stop surfaces acting as stoppages in one direction in space, whereby the bands can only be bent or curved in one direction in space. Alternatively, it concerns member bodies which are bonded to a carrier band and likewise have stop surfaces allowing a curvature in only one direction in space and blocking in the opposite direction in space.

The invention is based on the object to provide a finger protector for a sports glove which on one hand offers a production feasibility which is as simple and cost-effective as possible, and on the other hand allows an individual and readily changeable adjustment of the elasticity and torsional stiffness of each single protective strip associated to a specific finger, in fact independent from the respective properties of the strips associated to the other fingers.

This object is met according to the invention by a finger protector comprising the features of claim 1. The finger protector according to the invention is characterized in that each strip consists of a) a chain of members which are connected in one piece with each other and can be moved relative to each other in two opposite directions by means of through holes extending transverse to the chain direction, and b) a member band with nipples which are pushed into the through holes, so that the mobility of the members is impeded only in one of the two opposite directions, without being canceled completely.

The one-piece design of the member chains, each protecting one finger of a hand, has the advantage—compared with the prior art multi-part member chains—that it can be done without hinges and articulations between the individual members as well as assembling these individual parts, which makes the production process considerably quicker, simpler and cheaper.

Designing a member band with nipples which can be pushed into the through holes of the member chain strips is connected with a double advantage: On the one hand, nearly any material properties (elasticity, rigidity, restoring force) of the member band which preferably is made of one piece of plastic, can be chosen and combined with the likewise selectable material properties of the member chain strips, so that the elasticity, flexural stiffness and restoring force of the finger protector can be adapted all in all to the individual needs and desires of a sportsman, in particular a goalkeeper.

On the other hand, the member band equipped with nipples does not show stop surfaces which collide in the pushed-in state and which would completely cancel or block the mobility of the members and of the strips formed from these in one direction.

It is with a ball that hits with high kinetic energy and only just touches the fingertips, that the resistance against the dangerous spraining of the finger tips to the rear is significantly increased by the finger protector according to the invention, without noticeably impairing the mobility of the hand and each individual finger. The wearer of a glove equipped with the finger protector according to the invention thus continues to have the feeling that he can bend and stretch the protected fingers independently of each other and that he is able to catch and block powerfully shot balls without any risk of injury.

It is preferred that the strips protecting each individual finger as seen in cross-section are curved such that the upper side is convex and the underside is concave, whereby a particularly good adaptation to the shape of the fingers to be protected is ensured.

Also of advantage is a preset curvature in the longitudinal direction of the strips, which corresponds to the natural curvature of a relaxed hand, because the restoring force inherent to the material will continually and automatically strive for such preset curvature—which is advantageous especially for a goalkeeper—with any movement of the hand.

The through holes extending transverse to the chain direction of the strips preferably are configured as transverse slots limiting the side edges of the strips by narrow bridges which result from producing the strips in one piece. Due to this, the individual members and the strips formed from these will obtain a mobility and flexibility as it has been achieved so far only by means of complicated hinges between the individual members. Due to the fact that the slots can be provided on the material strips by simple stamping steps, such production is far simpler and more cost-effective than manufacturing the hinges.

In an advantageous embodiment of the finger protector according to the invention the slots have an additional recess of which geometric shape is adapted to that of the nipples of the member band. A circular hole provided in the center of the slots is particularly of advantage when the hole diameter is selected such that the nipples of the member bands employed can be pushed into the slots without any particular effort.

In this arrangement, it will be understood by a person skilled in the art that the spacing of the nipples of the member bands is adapted to the spacing of the through holes extending transverse to the chain direction of the members, similar to the circumstance where the spacing of the buttons of a button fly is adapted to the spacing of the corresponding buttonholes.

The additional recesses in the slots may also be arranged off-center, of course, and have a polygonal cross-section instead of a circular one, as long as the geometric shapes are adapted to those of the nipples and member bands.

The nipples preferably have a collar or an undercut which reaches behind the material of the respective protective strip in those regions which limit the through holes, or which snaps in place therewith. With this embodiment, the nipples look like little hats or the heads of mushrooms which can be pushed through the slots and optionally through the additional recesses at a relatively low effort, but in the other direction they can be pulled out at a relatively high effort only, although pulling out or undoing the push-in connection is possible at any time in order to e.g. replace a member band having a relatively low flexural stiffness with a member band having a higher flexural stiffness whenever the wearer of a glove equipped therewith considers it desirable or necessary in order to generally stiffen the glove or enhance its protective function.

It is preferred that the one-piece connection between the strips and the plate is reinforced by ribs or lands which can be integrated from the start by an appropriate design of the injection-molding tool.

The plate preferably has through holes between the reinforcement ribs in order to increase the bending property and flexibility of the finger protector in the region of the back portion of the hand and at the same time reduce the weight of the protector.

The plate, the strips and the member bands preferably are made from plastic, with the choice that thermoplastics, elastomers and thermoplastics modified with elastomers can be employed as plastics. It is particularly preferred that the plastic is selected from the group consisting of polyethylene, polypropylene, polystyrene, polyvinylchloride, polyamide, polymethyl(meth)acrylate, polyurethane, rubber or mixtures of these or copolymers thereof. The plastic employed may be used in foamed or non-foamed condition.

In order to be able to facilitate the pushing-in of the member bands, equipped with nipples, into the through holes between the individual members and to keep the material thicknesses as fine as possible, the material layers encompassing the through holes preferably have a thickness smaller than that of the members of the strips.

It is particularly preferred that the strips are made of a composite of at least two plastic layers, with the material encompassing the through holes being made of a smaller number of layers than the remaining parts of the strips, for instance of only one single layer, while the remaining parts of the strips possibly are made up of two or three layers. It is particularly of advantage with this preferred embodiment if the at least two plastic layers consist of plastics with differing hardness and elasticity, with the softer layer being situated underneath so as to face the finger to be protected.

A depression is preferably formed in the underside of the members of the strips, this depression having the shape of a longitudinal groove extending in chain direction and serving for receiving the member band. Through this it is avoided that the member band protrudes from the preferably concavely curved surface of the underside of the strip and it is pressed against the upper side of the finger to be protected when the protector is integrated into a sports glove.

With a particularly preferred embodiment of the invention, the member band which preferably is equipped with nipples on one side only, is interchangeably pushed into the through holes extending transverse to the chain direction, such pushing operation being effected from the underside of the strips. If member bands with differing flexural stiffness or differing hardness or else differing material properties are dyed in different colors, then it will be particularly easy for the sportsman to exchange them with the aim to adapt the mechanical properties of the finger protector to the respective requirements in the desired way.

The individual members of the member band are connected with each other preferably through constrictions or diminished material portions. With another advantageous embodiment of the invention the members of the member band are slotted by means of incisions underneath the nipples, without the one-piece design of the member band being canceled thereby. Such additional slots reduce the flexural stiffness of the member band in the bending direction of the fingers quite considerably, whereby—among the various materials that can be selected—there is made available a further measure allowing to individually vary the mechanical properties of the finger protector and adapt them to the respective needs.

So as to obtain an enhanced protection for the fingertips and for reasons of mechanical strength of the entire finger protector the first and last members of each single strip can be lengthened and/or stiffened.

Although in theory the finger protector could be produced and used so as to have only one single strip for protecting one single finger, its substantial advantages will show their full effect only when it has at least two strips for protecting two fingers. Particularly advantageous is a finger protector with four or five strips, for protecting the four fingers of a hand (without the thumb), or for protecting all five fingers of a hand, including the thumb.

The finger protector according to the invention is integrated in that part of a glove which is associated to the back portion of the hand, and in such a manner that it is surrounded on all sides by a soft foam plastic layer or foamed textile composite layer. It may be integrally embedded in foam or be sewn up; it is preferred, however, that it is detachably and interchangeably embedded in the glove part associated to the back portion of the hand, so that it can be replaced at any time by a protector having a differing flexural stiffness or hardness; likewise it is possible that merely the protector's properties are modified by replacing one or more member bands whereupon it will again be inserted in the same glove. The way how integration of the finger protector in a sport glove, in particular goalkeeper glove, has to be done in detail, is known and common to a person skilled in the art. To give an example, there may be provided openings in the glove which can be closed by means of Velcro fasteners.

Further details of the invention will be described in the following in connection with the drawing:

FIG. 4 is a side view of a further embodiment of a member band which can be pushed in.

Figure 1:
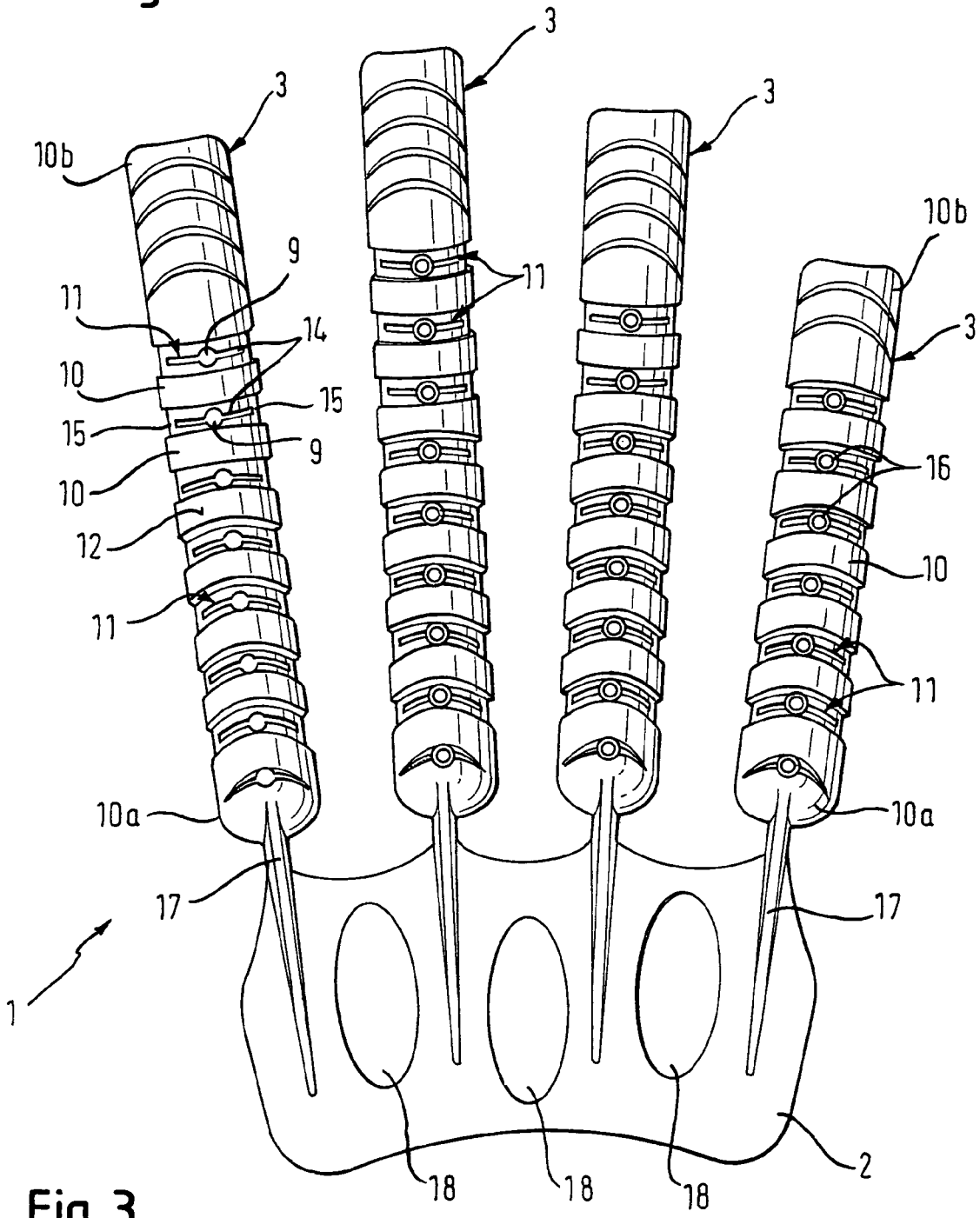
FIG. 1 is a top view of the upper side of a preferred embodiment of the finger protector according to the invention.
Figure 2:
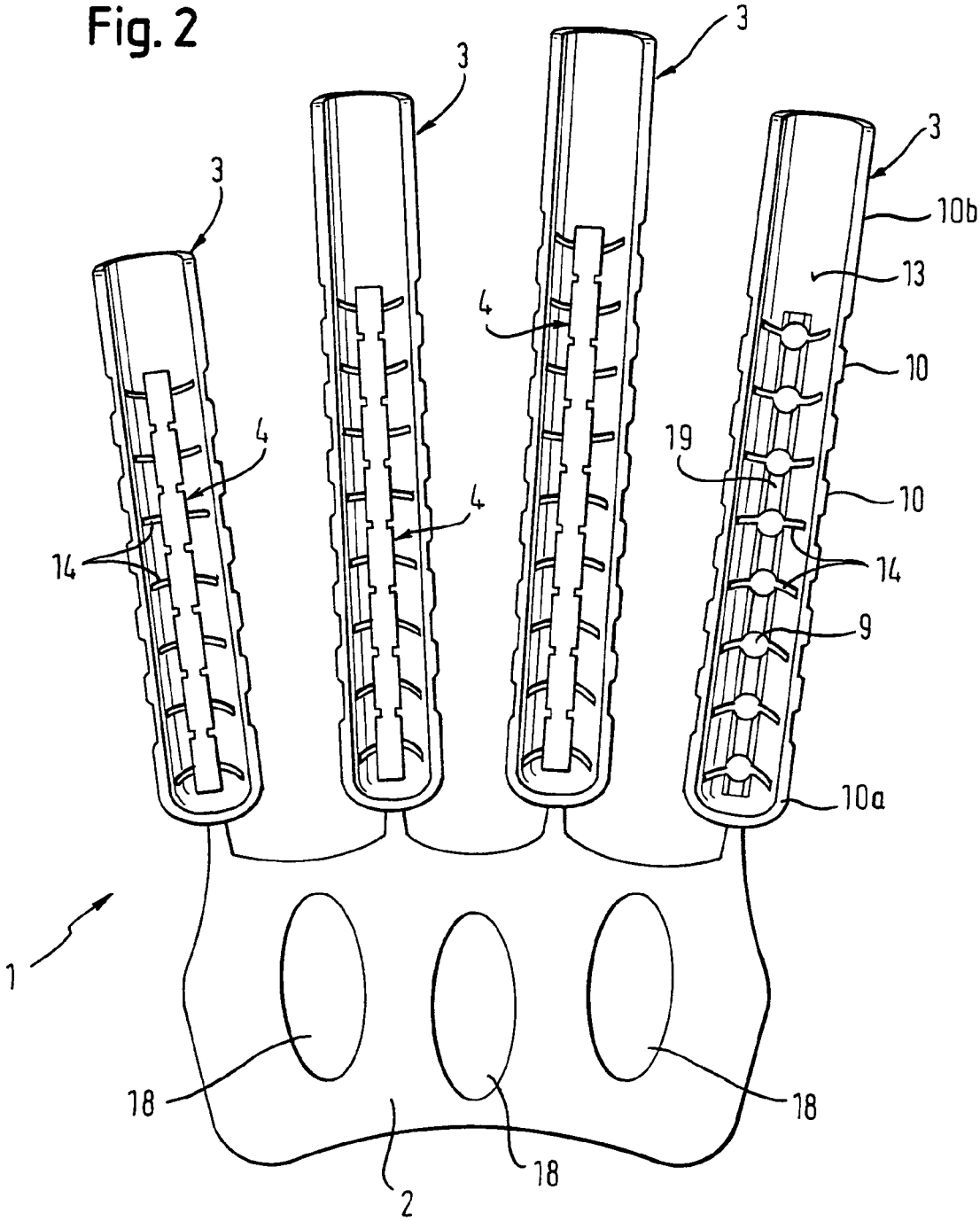
FIG. 2 is a top view of the underside of the finger protector of FIG. 1.

The finger protector 1 (FIGS. 1 and 2) designated for being used in a goalkeeper glove and serving for the protection of the right hand of the goalkeeper, consists of a plate 2 that is connected in one piece with strips 3 to be associated to four fingers of a hand; these four strips in FIG. 1, as seen from left to right, serve for protecting the forefinger, middle finger, ring finger and little finger and thus are associated to these fingers. Each strip 3 is connected with the plate 2 through reinforcing ribs 17, the plate having through holes 18 between these reinforcing ribs 17 for increasing the flexibility of the plate and for saving weight.

Each strip 3 consists of a chain of members 10 that are connected in one piece with each other, including the lengthened and stiffened first and end members 10*a*, 10*b*. It is by means of through holes 11 extending transverse to the chain direction that the members 10 can be moved in two opposite directions, namely in each case in a plane standing perpendicular to the plane of paper.

The through holes 11 are configured as slots 14 which additionally have in their center a circular recess 9 in the manner of a buttonhole. The slots 14 are limited at the side edges of the strips 3 by narrow bridges 15 extending in the longitudinal direction, so that the individual members 10 of each strip remain to be connected in one piece with each other.

For a better adaptation of the strips 3 to the surface of the fingers of a sportsman which are to be protected, the strips are curved in cross-section such that the upper side 12 is convex and the underside 13 (FIG. 2) is concave. Moreover, the strips 3 have a preset curvature in the longitudinal direction according to the natural finger curvature of a relaxed hand.

The underside 13 of the members 10 each shows a depression 19 in the form of a longitudinal groove extending in the chain direction and destined for receiving a member band 4.

Figure 3:
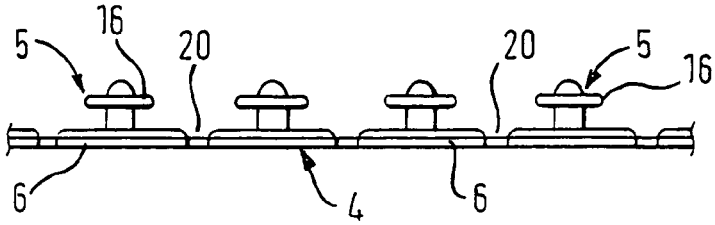
FIG. 3 is a side view of a member band with nipples for being pushed into the finger protector according to FIGS. 1 and 2.
Figure 4:
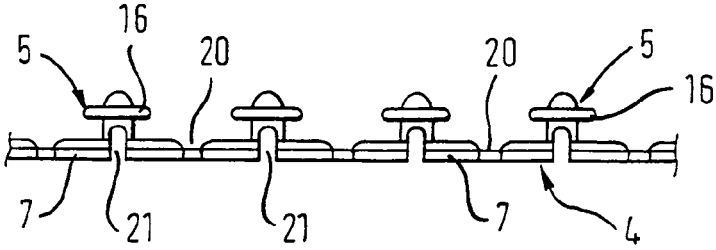

The member band 4 (FIGS. 3 and 4) consists of individual members which preferably are made of plastic and connected with each other through constrictions 20 or corresponding diminished material portions. Each member band 4 is provided with nipples 5 on one side, which in the drawn embodiment have a disc-shaped collar 16 and thus have the appearance of a little hat or resemble the head of a mushroom. The spacing of the nipples 5 is adapted to the spacing of the through holes 11 in the strips 3, and the geometric shape as well as the dimensions of the collars 16 are adapted to the slots 14 and the additional recesses 9.

With their nipples 5, the member bands 4 are pushed into the through holes of the strips 3 from the underside 13, so that the collars 16 reach behind the material of the strip 3 which defines the through holes 11, and the members 6 remaining at the underside 13 are flush or almost flush with the depression 19.

In a further embodiment (FIG. 4) of the member band 4 the members 7 of the member band 4 are cut or slotted underneath the nipples 5 by means of incisions 21 in order to further increase the chain-like mobility of the member band 4 without canceling the one-piece design of the member band 4 including the nipples 5.

In the drawn embodiment the strips 3 consist of a composite of two plastic layers made of a thermoplastic elastomer and having differing hardness and elasticity values, with the softer layer being arranged underneath so as to face the fingers to be protected.

The invention claimed is:

1. A finger protector comprising a plate that is connected in one piece with strips to be associated to several fingers of one hand, characterized in that each strip consists of a) a chain of members which are connected in one piece with each other and can be moved relative to each other in two opposite directions by means of through holes extending completely through the strip and transverse to the chain direction, and b) a member band which is a separate piece from said chain of members and which includes areas of diminished thickness in which areas are located nipples which are pushed into the through holes.

2. The finger protector according to claim 1, characterized in that the strips as seen in cross-section are curved such that the upper side is convex and the underside is concave.

3. The finger protector according to claim 2, characterized in that the strips have a preset curvature in the longitudinal direction which corresponds to the natural curvature of a relaxed hand.

4. The finger protector according to claim 3 characterized in that the through holes are configured as slots limited by narrow bridges.

5. The finger protector according to claim 4, characterized in that the slots have an additional recess with a circular shape adapted to that of the nipples.

6. The finger protector according to claim 5, characterized in that the nipples have a collar or an undercut which reaches behind the strip material limiting the through holes in place therewith, such that said nipples can be inserted into the slots at relatively low effort but require a higher level of effort to pull them out from the slots.

7. The finger protector according to claim 6, characterized in that the one-piece connection between the strips and the plate is reinforced by ribs or bands.

8. The finger protector according to claim 7, characterized in that the plate has through holes between the reinforcement ribs.

9. The finger protector according to claim 1, characterized in that the plate, the strips and the member bands are made of plastic.

10. The finger protector according to claim 9, characterized in that the plastic is a thermoplastic, an elastomer or a thermoplastic modified with elastomers.

11. The finger protector according to claim 10, characterized in that the plastic is selected from the group consisting of polyethylene, polypropylene, polystyrene, polyvinylchloride, polyamide, polymethyl(meth)acrylate, polyurethane, rubber and mixtures or copolymers thereof.

12. The finger protector according to claim 11, characterized in that the plastic is foamed.

13. The finger protector according to claim 1, characterized in that the lateral areas of the chain of members encompassing the through holes have a thickness smaller than that of the remainder of the strips.

14. The finger protector according to claim 13, characterized in that the strips are made from a composite of at least two plastic layers, with the material encompassing the through holes being made from a smaller number of layers than the remaining parts of the strips.

15. The finger protector according to claim 14, characterized in that at least two plastic layers consist of plastics with differing hardness and elasticity, with the softer layer being situated underneath so as to face the finger to be protected.

16. The finger protector according to claim 1, characterized in that a depression is formed relative to the surrounding surface of the underside of the members, this depression having the shape of a longitudinal groove extending in chain direction and serving for receiving the member band.

17. The finger protector according to claim 1, characterized in that only one side of the member band is equipped with the nipples.

18. The finger protector according to claim 17, characterized in that the members of the member band are slotted by means of incisions underneath the nipples.

19. The finger protector according to claim 1, characterized in that the first and last members of each strip are lengthened, stiffened or a combination thereof, relative to the other members of the strip.

20. The finger protector according to claim 1, characterized in that it has at least four strips.

21. A sports glove comprising a finger protector according to claim 1.

22. The sports glove according to claim 21, characterized in that the finger protector is detachably and interchangeably embedded in the glove part associated with the back portion of the hand.

* * * * *